US006971517B2

(12) United States Patent
Chen

(10) Patent No.: US 6,971,517 B2
(45) Date of Patent: Dec. 6, 2005

(54) ATTACHE STYLE TOOLBOX WITH AN OUTER FRAME

(76) Inventor: Kun-Chen Chen, No. 6, Lane 609, Sec. 1, Chung-Shan Rd., Ye-Her Li, Tachia Chen, Taichung Hsien (TW)

( * ) Notice: Subject to any disclaimer, the term of this patent is extended or adjusted under 35 U.S.C. 154(b) by 0 days.

(21) Appl. No.: 10/839,342

(22) Filed: May 6, 2004

(65) Prior Publication Data

US 2005/0247586 A1 Nov. 10, 2005

(51) Int. Cl.[7] ..... B65D 85/28

(52) U.S. Cl. ..... 206/372; 206/373; 190/122; 190/127; 220/4.01

(58) Field of Search ..... 194/24, 103, 104, 194/122, 123, 124, 127; 206/372–378; 220/4.04, 220/640, 643, 646; 150/127, 130

(56) References Cited

U.S. PATENT DOCUMENTS 110,552 A * 12/1870 Daggett ..... 190/24
1,468,816 A * 9/1923 Johnson ..... 150/130
4,630,717 A * 12/1986 Tong ..... 190/104
5,957,286 A * 9/1999 Ho ..... 206/373
6,050,373 A * 4/2000 Wonka et al. ..... 190/103
6,234,287 B1 * 5/2001 Pfeiffer ..... 190/123

* cited by examiner

*Primary Examiner*—Mickey Yu
*Assistant Examiner*—Jerrold Johnson
(74) *Attorney, Agent, or Firm*—Hershkovitz & Associates; Abe Hershkovitz

(57) ABSTRACT

An attache style toolbox with an outer frame includes two hollow half bodies (10) to hold multiple tools and an outer frame (20) to hold the two half bodies (10). Each half body (10) has multiple strips (12) formed on an outer periphery of the half body (10) and multiple through holes (147) defined inside the half body (10). The outer frame (20) is composed of two shells (22), and each shell (22) accommodates one half body (10) and has two strip recesses (224) mating with the strip (12) on the half body (10). Each shell (22) further has multiple retaining posts (29) extending inward to respectively engage the multiple through holes (147) and be held together by threaded rods. Therefore, the outer frame (20) is firmly combined with the two half bodies (10) to provide protection and attractiveness to the attache style toolbox.

7 Claims, 6 Drawing Sheets

ATTACHE STYLE TOOLBOX WITH AN OUTER FRAME

BACKGROUND OF THE INVENTION

1. Field of the Invention

The present invention relates to an attache style toolbox, and more particularly to an attache style toolbox with an outer frame that protects the attache style toolbox and increases versatile appearances of the attache style tool suitcase.

2. Description of Related Art

With reference to FIG. 6, a conventional attache style toolbox (50) is composed of two half bodies (52) made by blow-molding and a joint (54) integrally formed between the two half bodies (52). Therefore, the two half bodies (52) are hollow. Each half body (52) is a flat hexahedron and has a front end (not numbered), a rear end (not numbered), two side ends (not numbered), an inner surface (not numbered) and an outer surface (not numbered). One of the two half bodies (52) has a handle (522) attached to the front end and two clasps (524) attached respectively on opposite sides of the handle. The other half body (52) has two latch blocks (526) formed on the front end to be engaged respectively by the clasps (524). The two half bodies (52) are kept closed by the clasps (524) and the latch blocks (526). The joint (54) is integrally formed between the rear ends of the two half bodies (52). Because the attache style toolbox is made of resilient plastic, the joint (54) is flexible and bends to allow the attache style toolbox to be closed or opened.

However, the half bodies (52) are easily broken when the attache style toolbox (50) strikes an object because the half bodies (52) of the conventional attache style toolbox (50) are hollow. Additionally, the joint (54) wears out easily, which causes the two half bodies (52) to separate from each other. Therefore, the conventional attache style toolbox (50) is not durable.

Furthermore, the attache style toolbox (50) made by blow-molding only has a singular color that makes the attache style toolbox (50) toneless in appearance.

The present invention has arisen to mitigate or obviate the disadvantages of the conventional attache style tool suitcase.

SUMMARY OF THE INVENTION

The main objective of the present invention is to provide an attache style toolbox with an outer frame, which is durable and has an attractive appearance.

Further benefits and advantages of the present invention will become apparent after a careful reading of the detailed description with appropriate reference to the accompanying drawings.

DETAILED DESCRIPTION OF THE PREFERRED EMBODIMENT

Figure 1:
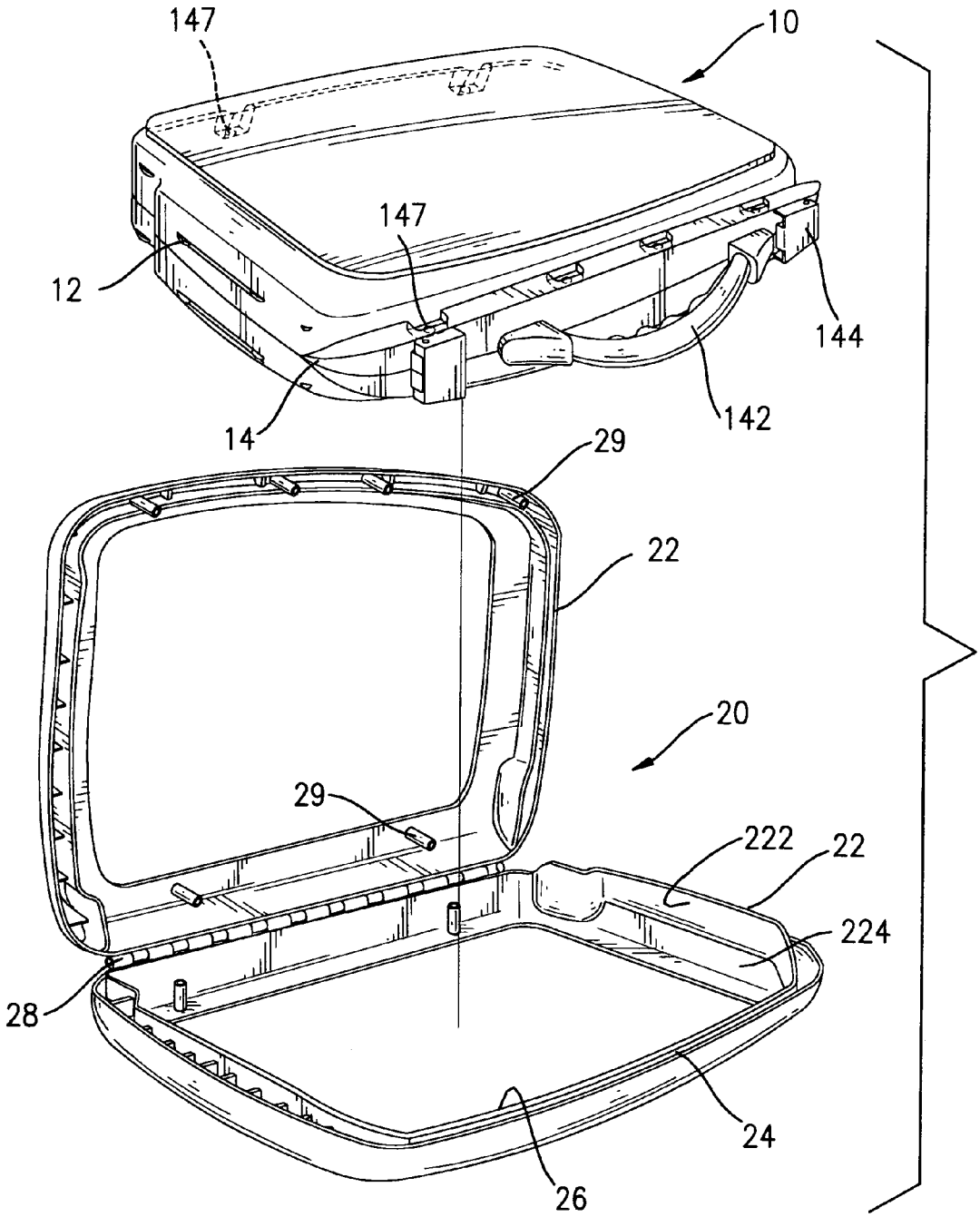
FIG. 1 is an exploded perspective view of an attache style toolbox with an outer frame in accordance with the present invention.
Figure 2:
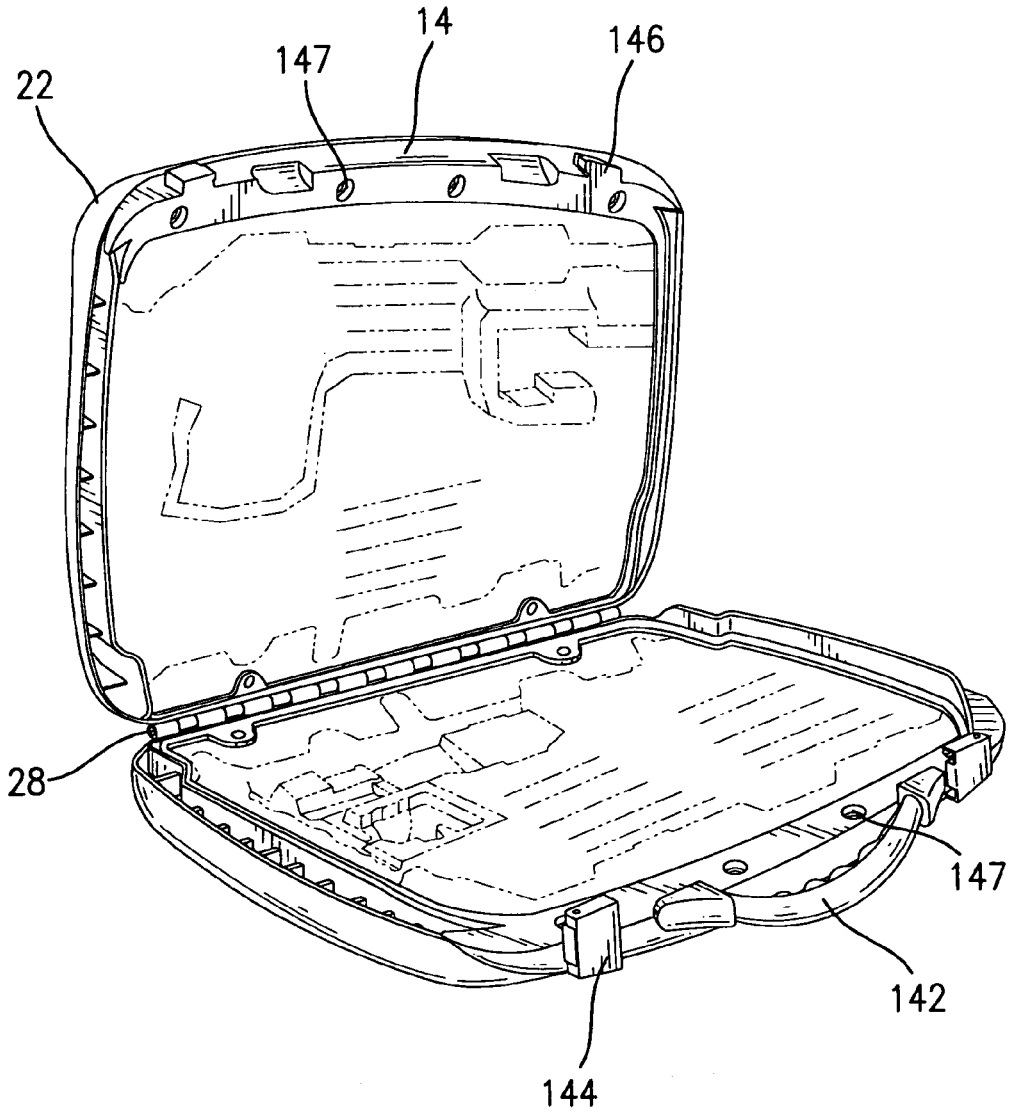
FIG. 2 is a perspective view of the attache style toolbox with an outer frame in FIG. 1.
Figure 3:
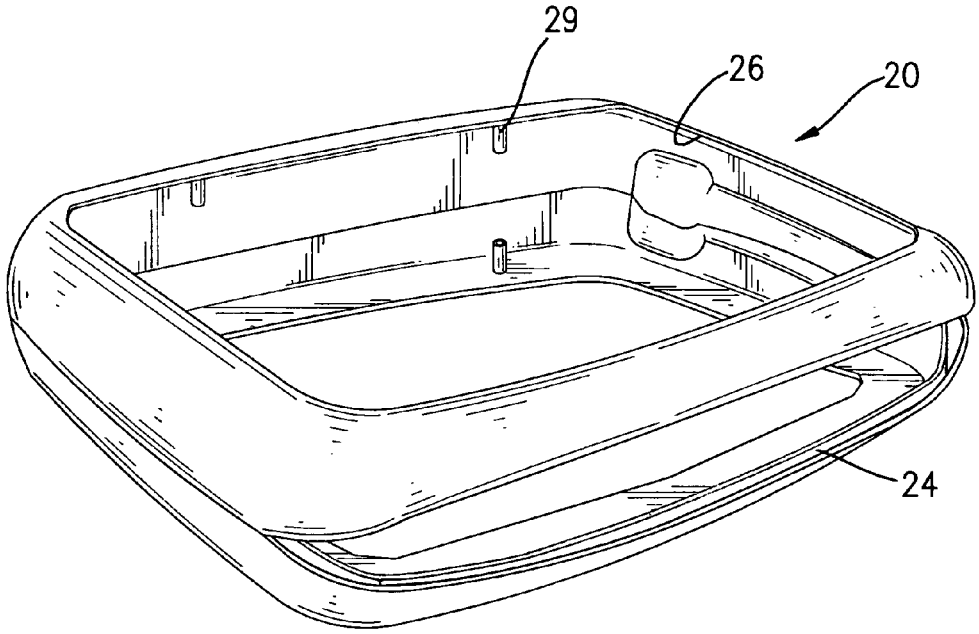
FIG. 3 is a perspective view of the outer frame in FIG. 1.

With reference to FIGS. 1, 2 and 3, an attache style toolbox with an outer frame in accordance with the present invention comprises two half bodies (10) and an outer frame (20) to hold the two half bodies (10).

Each of the two half bodies (10) is a flat hexahedron with a front end (not numbered), a rear end (not numbered), two side ends (not numbered), an inner face (not numbered), an outer face (not numbered), multiple tool recesses (not numbered), two strips (12), a locking flange (14) and multiple through holes (147). The two strips (12) are formed respectively on the two side ends of each half body (10), and the locking flange (14) is formed on the front end of the half body (10). The multiple tool recesses are defined in the inner face of the half body (10) to accommodate various tools inside the attache style tool suitcase. The multiple through holes (147) are defined in each locking flange (14) to allow screws respectively to penetrate. Preferably, multiple through holes (not numbered) are defined respectively through the two half bodies (10). One of the two half bodies (10) has an optional handle (142) attached to the locking flange (14) and two optional clasps (144) are attached respectively at opposite sides of the handle (142). The other half body (10) has two optional latch blocks (146) formed on the locking flange (14) to engage respectively the two clasps (144). Thereby, the two half bodies (10) can be held together by the clasps (144) and the latch blocks (146). Particularly, the two half bodies (10) are two separate pieces unlike the conventional one-piece attache style toolbox.

The outer frame (20) is composed of two shells (22) pivotally connected to each other. Each shell (20) is rectangular and has a front edge (not numbered), a rear edge (not numbered), two sides edge (not numbered), an inner cavity (222), an outer surface (not numbered), two strip recesses (224), a cutout (24), multiple hinge knuckles (28), multiple retaining posts (29), and an optional window (26). The inner cavity (222) of each shell (22) accommodates a corresponding half body (10) and has the two strip recesses (224) defined at inner surfaces at the opposite side edges of the shell (22). The cutout (24) is defined in the front edge of the shell (20) to allow the locking flange (14) of the corresponding half body (10) to penetrate. Therefore, the latch device can be operated from outside the outer frame (20). The multiple hinge knuckles (28) are formed on the rear edge with intervals (not numbered) between adjacent hinge knuckles (28). When the two shells (22) are assembled, the hinge knuckles (28) on one shell (22) fit into the intervals in the other shell (22). Then, a pivotal pin (not shown) passes through all hinge knuckles (28) of the two shells (22) to pivotally connect the two shells (22) together. The multiple retaining posts (29) are respectively formed at the front edge and the rear edge inside the inner cavity (222) to respectively engage the through holes (147) in the corresponding half body (10). Each retaining posts (29) has a threaded hole (not numbered) defined axially to allow a threaded rod (not numbered) to be screwed into the threaded hole and be secured with a nut to firmly connect the shell (22) to the corresponding half body (10). Additionally, the optional window (26) may be defined in a bottom of the inner cavity (222) through the shell (22).

Figure 4:
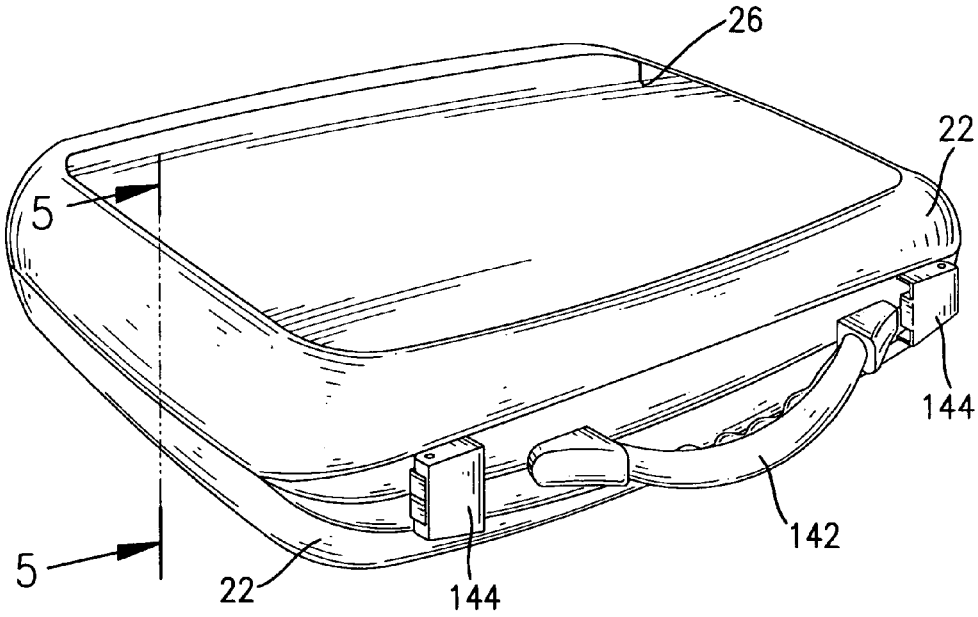
FIG. 4 is a perspective view of the attache style toolbox with an outer frame in FIG. 2.
Figure 5:
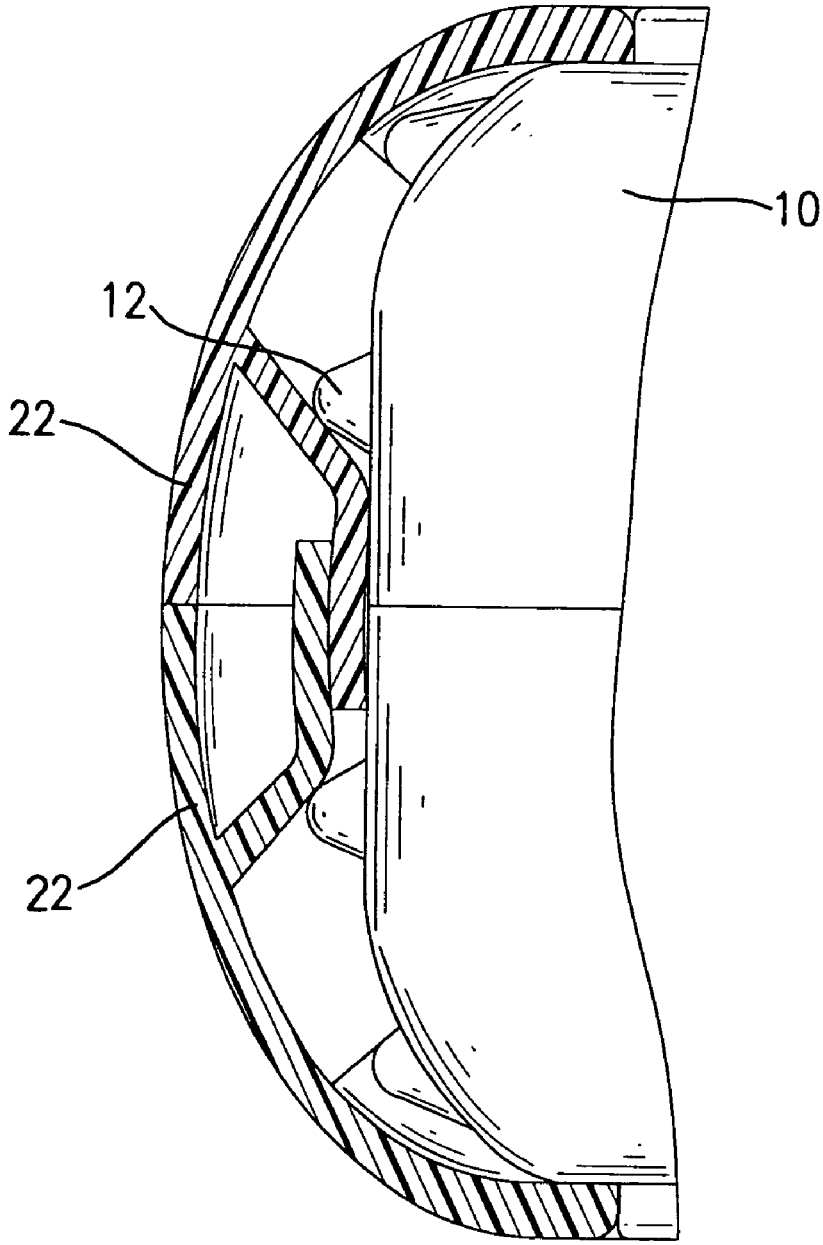
FIG. 5 is a cross-sectional front plan view of the attache style toolbox with an outer frame along ling 5—5 in FIG. 4.
Figure 6:
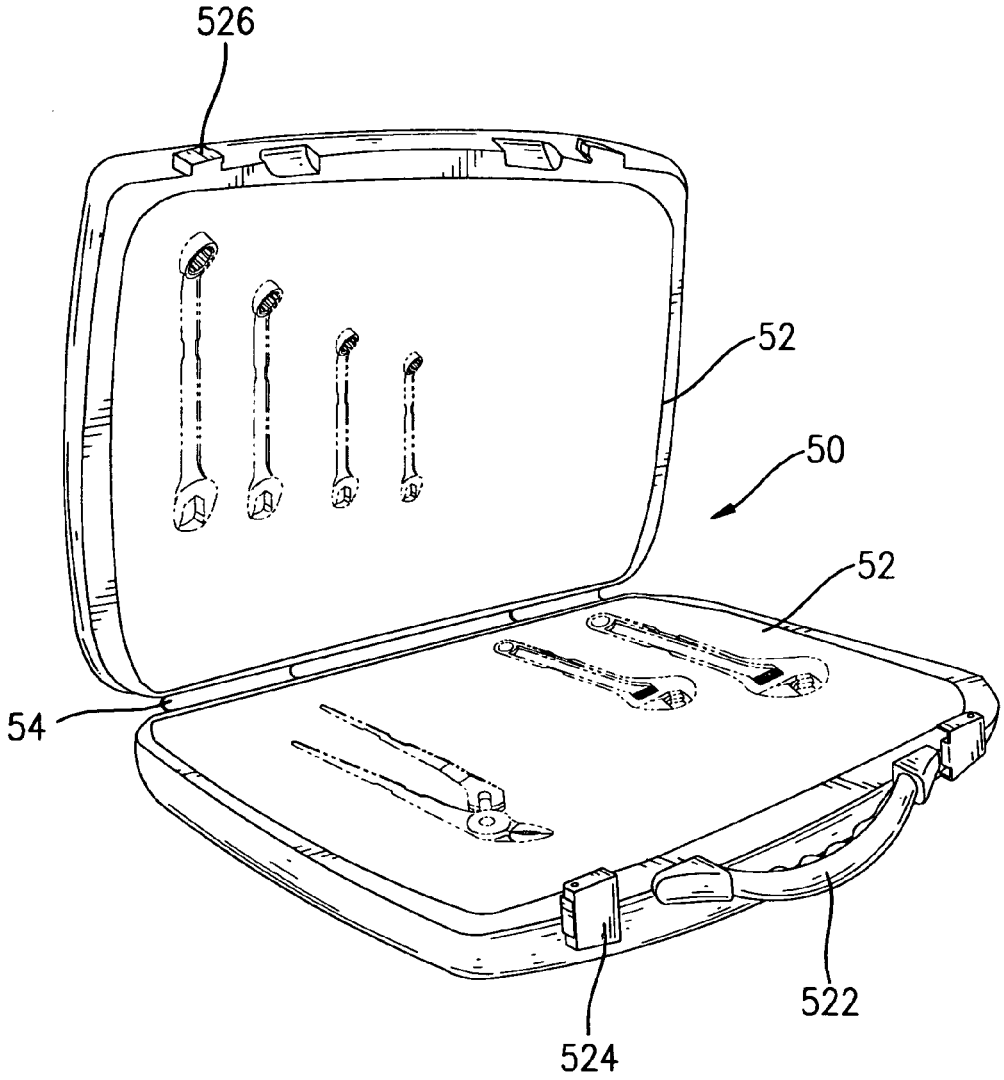
FIG. 6 PRIOR ART
FIG. 6 is a perspective view of a conventional attache style toolbox in accordance with the prior art.

With further reference to FIGS. 4 and 5, the strips (12) are wedged into the strip recesses (224) to hold the half bodies

(10) in the shells (22) when the two half bodies (10) are respectively combined with the shells (22). Additionally, the retaining posts (29) of the shells (22) engage the through holes (147) in the half bodies (10) and are held in place by threaded rods to precisely and firmly hold the half bodies (10) inside the outer frame (20).

To increase attractiveness of the appearance of the attache style toolbox, the outer frame (20) may be produced in different colors from the half bodies (10). Furthermore, the windows (26) in the shells (22) may be different patterns to make the attache style toolbox versatile.

The attache style toolbox in accordance with the present invention has the following advantages.

1. The outer frame (20) protects the hollow half bodies (10) from bumping against other objects.

2. The shells (22) are connected pivotally by a pivotal pin and hinge knuckles (28) to substitute for the integral resilient joint between two conventional half bodies. Such pivotal devices have better wear-resistance than the conventional integral resilient joint so the attache style toolbox of the present invention is durable.

3. The outer frame (20) with windows is in a different color from the color of the half bodies (10), which makes the appearance of the attache style toolbox vivid and attractive.

Although the invention has been explained in relation to its preferred embodiment, many other possible modifications and variations can be made without departing from the spirit and scope of the invention as hereinafter claimed.

What is claimed is:

1. An attache style toolbox with an outer frame comprising:

two half bodies (10), each of the two half bodies (10) having a front end, a rear end, two side ends, an inner face and an outer face, and having two strips (12) respectively formed on opposite side ends of each half body (10);

a locking flange (14) formed at the front end of each of the two half bodies (10);

multiple through holes (147) defined in the locking flange (14) and the rear end of each of the two half bodies (10); and multiple tool recesses defined on the inner face; and two shells (22) pivotally connected to form the outer frame, each of the two shells (22) having a front edge, a rear edge, two side edges, an inner cavity (222) and an outer surface, and having two strip recesses (224) defined at the opposite side edges inside the inner cavity (222);

multiple retaining posts (29) respectively formed at the front edge and the rear edge inside the inner cavity (222) to respectively engage the multiple through holes (147) in the corresponding half body (10); and a window (26) defined through each of the two shells (22).

2. The attache style toolbox with an outer frame as claimed in claim 1, wherein each of the two shells (22) has multiple hinge knuckles (28) transversally formed on the rear edge with intervals between two adjacent hinge knuckles (28) and a pivotal pin penetrates all hinge knuckles (28) of the two shells (22);

wherein, each one of the multiple hinge knuckles (28) on one shell (22) located at the intervals on the other shell (22).

3. The attache style toolbox with an outer frame as claimed in claim 1, wherein each of the two shells (22) has a cutout (24) defined at the front edge of the shell (20) to allow the locking flange (14) of one corresponding half body (10) to penetrate.

4. The attache style toolbox with an outer frame as claimed in claim 3, wherein each of the two shells (22) has multiple hinge knuckles (28) transversally formed on the rear edge with intervals between two adjacent hinge knuckles (28) and a pivotal pin penetrates all hinge knuckles (28) of the two shells (22);

wherein, each one of the multiple hinge knuckles (28) on one shell (22) located at the intervals on the other shell (22).

5. The attache style toolbox with an outer frame as claimed in claim 1, wherein the attache style toolbox further has:

a handle (142) attached to the locking flange (14) on one of the half bodies (10) for holding;

two clasps (144) respectively attached to the locking flange (14) beside the handle (142); and two latch blocks (146) formed on the locking flange (14) on the other one of the half bodies (10) to respectively engage with the two clasps (144).

6. The attache style toolbox with an outer frame as claimed in claim 5, wherein each of the two shells (22) has multiple hinge knuckles (28) transversally formed on the rear edge with intervals between two adjacent hinge knuckles (28) and a pivotal pin penetrates all hinge knuckles (28) of the two shells (22);

wherein, each one of the multiple hinge knuckles (28) on one shell (22) located at the intervals on the other shell (22).

7. The attache style toolbox with an outer frame as claimed in claim 5, wherein each of the two shells (22) has a cutout (24) defined at the front edge of the shell (20) to allow the locking flange (14) of one corresponding half body (10) to penetrate.

* * * * *